US008875943B2

(12) United States Patent
Benedetti

(10) Patent No.: US 8,875,943 B2
(45) Date of Patent: Nov. 4, 2014

(54) DISPENSER ASSEMBLY

(75) Inventor: Giovanni Benedetti, Wishaw (GB)

(73) Assignee: SCA Hygiene Products AB, Göteborg (SE)

( * ) Notice: Subject to any disclaimer, the term of this patent is extended or adjusted under 35 U.S.C. 154(b) by 0 days.

(21) Appl. No.: 13/381,178

(22) PCT Filed: Jun. 30, 2009

(86) PCT No.: PCT/SE2009/050836

§ 371 (c)(1),
(2), (4) Date: Dec. 28, 2011

(87) PCT Pub. No.: WO2011/002359

PCT Pub. Date: Jan. 6, 2011

(65) Prior Publication Data

US 2012/0097701 A1 Apr. 26, 2012

(51) Int. Cl.
*A47K 17/00* (2006.01)
*A47K 10/32* (2006.01)

(52) U.S. Cl.
CPC ..... *A47K 10/32* (2013.01); *A47K 2010/3246* (2013.01); *A47K 2010/3233* (2013.01)
USPC ..... 221/283; 221/45

(58) Field of Classification Search
USPC ..... 221/45, 282, 283
See application file for complete search history.

(56) References Cited

U.S. PATENT DOCUMENTS 1,913,142 A * 6/1933 Ondricek ..... 24/3.5
3,326,433 A * 6/1967 Koch ..... 224/235
4,058,235 A 11/1977 Cassia
5,277,315 A * 1/1994 Plein ..... 206/270
5,715,971 A 2/1998 Morand
6,196,605 B1 * 3/2001 Baldas et al. ..... 296/37.13
D473,437 S * 4/2003 Klein et al. ..... D8/34
6,869,041 B1 3/2005 Allegre et al.
7,341,166 B2 * 3/2008 Reinsel et al. ..... 221/59
7,472,974 B2 * 1/2009 Czach et al. ..... 312/405.1

(Continued)

OTHER PUBLICATIONS

International Search Report (PCT/ISA/210) issued on Mar. 16, 2010, by Swedish Patent Office as the International Searching Authority for International Application No. PCT/SE2009/050836.

(Continued)

*Primary Examiner* — Gene Crawford
*Assistant Examiner* — Kelvin L Randall, Jr.
(74) *Attorney, Agent, or Firm* — Buchanan Ingersoll & Rooney PC

(57) ABSTRACT

A dispenser assembly 1 including a dispenser 2 for hygienic articles and a mounting bracket 16 for releasably attaching the dispenser 2 to a wall. The dispenser 2 includes a container 4 provided with a dispensing aperture 6 for the hygienic articles and a first side portion adapted to be positioned adjacent the mounting bracket 16. Further the dispenser assembly includes a connecting arrangement for connecting the dispenser 2 to the mounting bracket 16. The connecting arrangement includes a locking interconnection 28 for securely holding the first side portion of the container 4 against the mounting bracket 16 and a guiding interconnection 42 for initially positioning the dispenser 2 in relation to the mounting bracket 16 during mounting of the dispenser 2 to the mounting bracket 16. The guiding interconnection 42 provides engagement between the dispenser 2 and the mounting bracket 16 such that the dispenser 2 is prevented from being separated from the mounting bracket 16 in a direction at least perpendicularly outwards from the wall.

12 Claims, 4 Drawing Sheets

(56) References Cited

U.S. PATENT DOCUMENTS

| | | | | |
|---|---|---|---|---|
| 7,530,471 | B2 * | 5/2009 | Cohen et al. | 221/48 |
| D630,405 | S * | 1/2011 | Healy | D34/10 |
| 2005/0056657 | A1 * | 3/2005 | Hochtritt et al. | 221/45 |
| 2005/0116596 | A1 * | 6/2005 | Leimkuehler et al. | 312/405.1 |
| 2006/0208129 | A1 | 9/2006 | Clark et al. | |
| 2008/0169411 | A1 * | 7/2008 | Quinn et al. | 248/691 |
| 2008/0313795 | A1 * | 12/2008 | Lu | 4/231 |
| 2009/0120951 | A1 * | 5/2009 | Titas et al. | 221/45 |
| 2010/0155426 | A1 * | 6/2010 | Hsu | 222/180 |

OTHER PUBLICATIONS

Written Opinion (PCT/ISA/237) issued on Mar. 16, 2010, by Swedish Patent Office as the International Searching Authority for International Application No. PCT/SE2009/050836.

* cited by examiner

DISPENSER ASSEMBLY

TECHNICAL FIELD

The disclosure relates to a dispenser assembly comprising a dispenser for hygienic articles.

Such a dispenser is suitable for containing and dispensing of flat elongated hygienic articles. Examples of such flat elongated hygienic articles are paper towels, sheets of tissues, napkins, diapers, female hygiene products and other fibrous, film, polymer or filamentary products.

BACKGROUND OF THE INVENTION

Dispensers for hygienic articles, e.g. paper towels are commonly but not exclusively mounted in restrooms or close to handbasins or sinks in public establishments, industrial or kitchen premises. The hygienic articles may form a stack inside the dispenser and are grasped by a user from the lower end of the stack through a dispensing aperture. Some hygienic articles may be provided on a roll, e.g. paper which at a free end may protrude from a dispenser.

A dispenser assembly is known from US 2006/0208129 A1, therein called a "kit". A mounting plate is disclosed to comprise two keys provided with key heads. The key heads turned in one position fit and extend though apertures in a back housing portion of a dispenser. Turned in a different position the key heads prevent the dispenser from being removed from the mounting plate by not aligning with the apertures in the back housing portion. A pair of spaced apart prongs is provided at a lower end of the mounting plate. These prongs are tapered at their free ends and are provided with a groove near the mounting plate. The back housing portion of the dispenser releasably locks to each prong as a perimeter surrounding each prong aperture provided in the back housing portion extend into the groove provided on the prong.

With reference to FIGS. 7A-7C in US 2006/0208129 A1 there is illustrated a sequence disclosing how the dispenser is to be mounted on the mounting plate. First the dispenser is aligned with the mounting plate, then the keys are inserted though the corresponding key apertures in the back housing portion of the dispenser. Finally, the prongs are inserted in the prong apertures of the back housing portion of the dispenser. This mounting of the dispenser can be cumbersome due to, inter alia, the requirement of aligning the key heads with the apertures, the aligning of the dispenser with the mounting plate and the inserting of the key heads/keys through the apertures.

SUMMARY OF THE INVENTION

An object of the present invention is to provide an easily mounted dispenser.

According to an aspect of the invention the object is achieved by a dispenser assembly comprising a dispenser for hygienic articles and a mounting bracket for releasably attaching the dispenser to a wall. The dispenser comprises a container provided with a dispensing aperture for the hygienic articles and an access opening. The container comprises a first side portion adapted to be positioned adjacent the mounting bracket. The dispenser further comprises a lid pivotally attached to the container and adapted to cover the access opening. The dispenser assembly comprises a connecting arrangement for connecting the dispenser to the mounting bracket. The connecting arrangement comprises a locking interconnection for securely holding the first side portion of the container against the mounting bracket. The connecting arrangement comprises a guiding interconnection for initially positioning the dispenser in relation to the mounting bracket during mounting of the dispenser to the mounting bracket, and wherein during the mounting of the dispenser to the mounting bracket the guiding interconnection provides engagement between the dispenser and the mounting bracket such that the dispenser is prevented from being separated from the mounting bracket in a direction at least perpendicularly outwards from the wall.

It is to be understood that the term "wall" is to be interpreted meaning any structure or device having an essentially vertical surface suitable for mounting a dispenser thereon, including a side wall of a cupboard and a door face. A "secure holding" by means of the locking interconnection means, that without manually affecting the locking interconnection the dispenser can not be separated from the mounting bracket without damaging either the wall, the dispenser, the mounting bracket or the connecting arrangement or parts thereof. Put differently, the locking interconnection provides a non-releasable connection between the first side portion of the container and the mounting bracket when the lid is closed and prevents access to the locking interconnection.

Since there is provided a guiding interconnection which initially holds the dispenser positioned in place on the mounting bracket by preventing it from being separated from the mounting bracket at least perpendicularly outwards from the wall, the locking interconnection of the connecting arrangement may be readily engaged. The guiding interconnection ensures that the dispenser is held in a correct position for the locking interconnection to be engaged.

As a result, the above mentioned object is achieved.

The guiding interconnection proving engagement between the dispenser and the mounting bracket such that the dispenser is prevented from being separated from the mounting bracket in a direction at least perpendicularly outwards from the wall may of course encompass preventing that the dispenser is separate in other directions than perpendicular, e.g. up to 20 degrees from the perpendicular direction or up to 45 degrees or greater from the perpendicular direction. The access opening may be used for replenishing the dispenser with the hygienic articles or for accessing the locking interconnection or both.

According to example embodiments it is foreseen that during the mounting the guiding interconnection may be engaged prior to the locking interconnection securing the dispenser against the mounting bracket. Again, the guiding interconnection provides that the dispenser is held in a correct position for the locking interconnection to be engaged.

According to example embodiments the guiding interconnection may comprise a slot and a hook having an end portion adapted to be inserted into the slot and to engage with an edge portion of the slot. Engaged in this manner, the hook and the slot may reliably position the dispenser in relation to the mounting bracket. The end portion may for instance extend in a downward direction and thus be adapted to engage with a lower edge portion of the slot.

According to example embodiments the locking interconnection may comprise a snap connection. By such a snap connection the dispenser may easily be connected to the mounting bracket by engaging the snap connection. This may suitably be done once the dispenser is positioned correctly in a horizontal and lateral direction over the mounting bracket by means of the guiding interconnection. The snap connection may be adapted to provide one-handed release of the locking interconnection. This may give e.g. service personnel a free hand for supporting the dispenser when it is removed from the mounting bracket. The snap connection may for instance comprise a resilient protrusion arranged on the mounting bracket, the resilient protrusion being provided with an end portion adapted to engage with an edge portion of a hole provided in the first side portion of the container.

According to example embodiments the hook of the guiding interconnection may be provided externally of the dispenser on the first side portion of the container and the slot of the guiding connection may accordingly be provided in the mounting bracket. Alternatively, the hook of the guiding interconnection may be provided on the mounting bracket on a side thereof facing the first side portion of the container and the slot of the guiding connection may accordingly be provided in the first side portion of the container.

According to example embodiments the guiding interconnection may comprise only one item each of the slot and the hook. This may facilitate the initial positioning of the container on the mounting bracket due to the requirement for only one interconnection to be engaged before the locking interconnection is engaged. The hook may have a lateral extension over a first length along the first side portion. Thus, the hook may abut the edge portion of the slot over the first length. This may facilitate angular positioning of the dispenser in an essentially vertical plane, i.e. the dispenser may easily be horizontally arranged on the mounting bracket during the initial positioning. The hook may be tapered at its free end such that it easily fits into the slot and such that it fills out the sot when the dispenser is mounted on the mounting bracket thus, positioning the dispenser in relation to the mounting bracket.

According to example embodiments the locking interconnection may be accessible through the access opening when the lid is open. By this arrangement the locking interconnection may be enclosed in the dispenser when the lid is closed. This may not only provide clean looks when the dispenser is arranged on the wall but may also make unauthorized access to the locking interconnection more difficult.

According to example embodiments the dispenser may be provided with a locking mechanism for maintaining the lid in a closed position on the container to prevent access through said access opening to the locking interconnection. Such a locking mechanism may commonly be provided with a removable key. Accordingly, when the locking mechanism is locked and the key is removed not only removal of hygiene articles through the access opening is prevented but also unauthorized removal of the dispenser is prevented.

According to example embodiments, a projection of the mounting bracket on the wall may be smaller than a projection of the dispenser on the wall. Accordingly, the mounting bracket is not visible when the dispenser is approached from its front and only the dispenser will be outlined against the wall.

According to example embodiments the dispenser may externally of the first side portion of the container be provided with a steering protrusion adapted to bear against the mounting bracket for lateral positioning of the dispenser in relation to the mounting bracket at least during engaging of the guiding connection. This may provide an easy engaging of the guiding connection. The steering protrusion may for instance comprise one or two ridges bearing against an outer surface of one or two vertical side portions of the mounting bracket.

According to example embodiments the dispenser assembly may comprises a second dispenser comprising a container provided with a first side portion adapted to be positioned adjacent and attached to the mounting bracket. Thus, it may be possible to utilize one mounting bracket for attaching different dispensers, one at a time, to a wall or similar structure. The dispensers may be of different kinds. Alternatively, the dispensers may be of the same kind. In the latter case it is foreseen that dispensers may be disposable, i.e. when a first dispenser has been emptied from hygienic articles it is removed from the mounting bracket and disposed of, and a full second dispenser is attached to the mounting bracket. Alternatively, dispensers may be reused but not replenished in place on the mounting bracket, i.e. when empty a first dispenser is removed from the mounting bracket and a full second dispenser is attached to the mounting bracket. Then the first dispenser is replenished with hygienic articles and thus prepared to be used again.

Further features of, and advantages with, the present invention will become apparent when studying the appended claims and the following description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present.

Well-known functions or constructions may not be described in detail for brevity and/or clarity.

Figure 1:
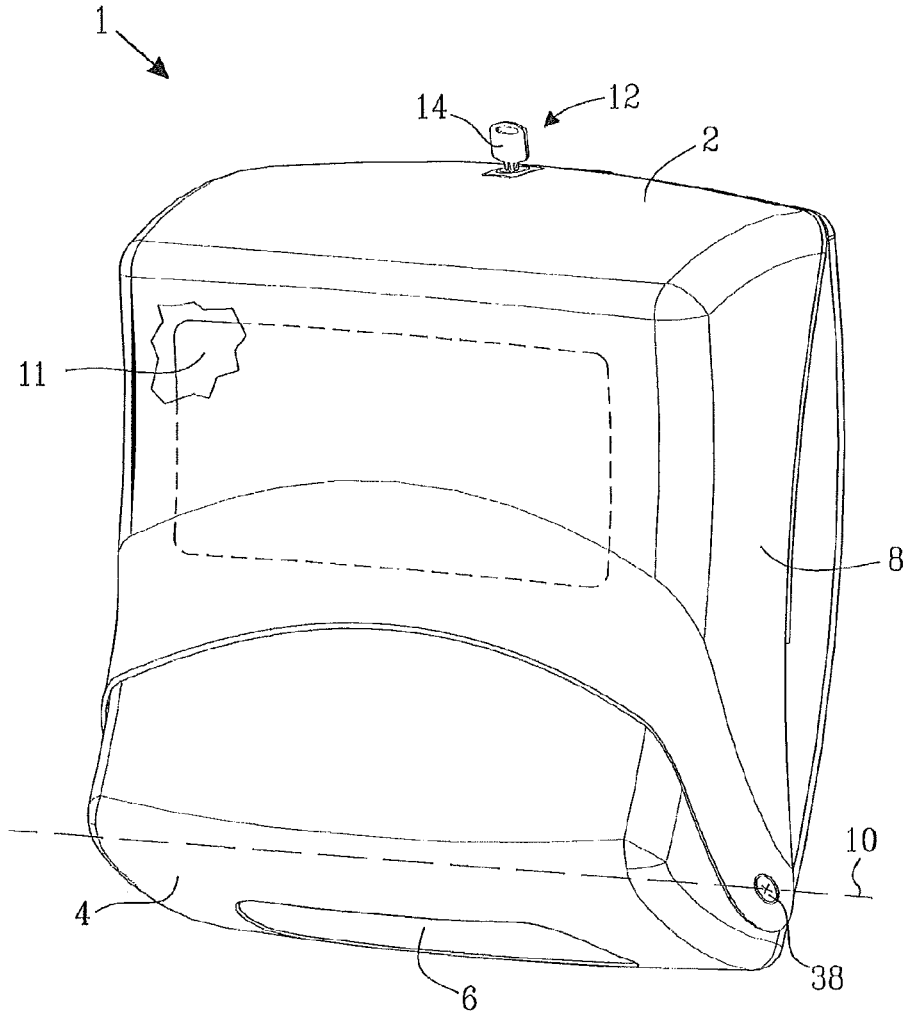
FIG. 1 illustrates a dispenser of a dispenser assembly according to example embodiments.

FIG. 1 illustrates a dispenser 2 of a dispenser assembly 1 according to example embodiments. The dispenser 2 is adapted to contain a stack of flat hygienic articles and comprises a container 4 which at its lower end is provided with a dispensing aperture 6, from which the hygienic articles are grasped by a user. A lid 8 is arranged on a front side of the container 4. The lid 8 may be pivoted about an essentially horizontal axis 10 from the illustrated closed position to an open position, in which an access opening 11 (shown in broken lines) provides access to an interior of the container 4. At its upper end the lid 8 is provided with a locking mechanism 12. The locking mechanism 12 may comprise a removable key 14. The lid 8 may thus be locked to the container 4 to prevent access to the access opening 11.

Figure 2:
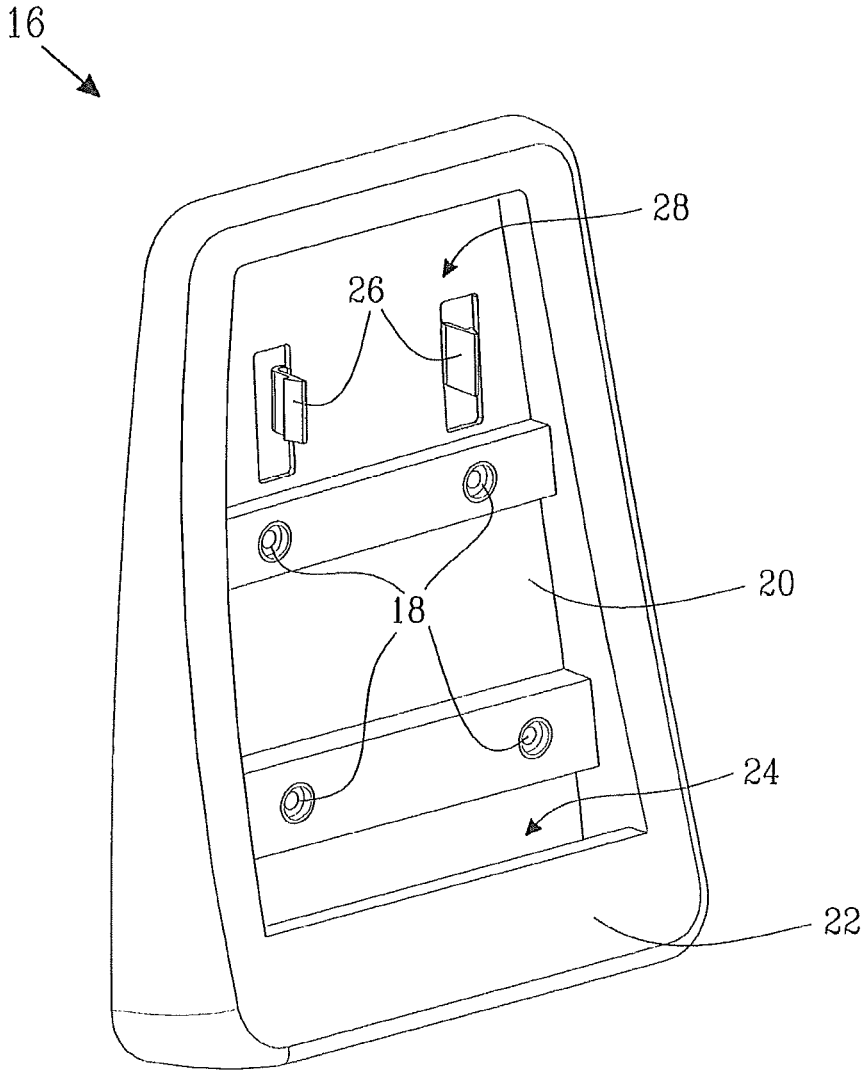
FIG. 2 illustrates a mounting bracket of a dispenser assembly according to example embodiments.

FIG. 2 illustrates a mounting bracket 16 of a dispenser assembly according to example embodiments. The mounting bracket 16 is adapted to be attached to a wall or similar structure, e.g. by means of bolts extending through attachment holes 18 in a rear side 20 of the mounting bracket 16. A front side 22 of the mounting bracket 16 has the shape of a generally rectangular frame. When the dispenser 2 is mounted on the mounting bracket 16, the front side 22 abuts against a first side portion at a rear side of the container 4.

At a lower end of the mounting bracket 16 there is provided a horizontal slot 24 between the front side 22 and the rear side 20. At an upper end of the mounting bracket 16 there are provided two resilient protrusions 26 forming part of a snap connection. The horizontal slot 24 forms part of a guiding interconnection and the snap connection forms part of a locking interconnection 28 of the dispenser assembly. The guiding interconnection and the locking interconnection form a connecting arrangement for connecting the dispenser 2 to the mounting bracket 16 and will be explained in more detail below.

Figure 3:
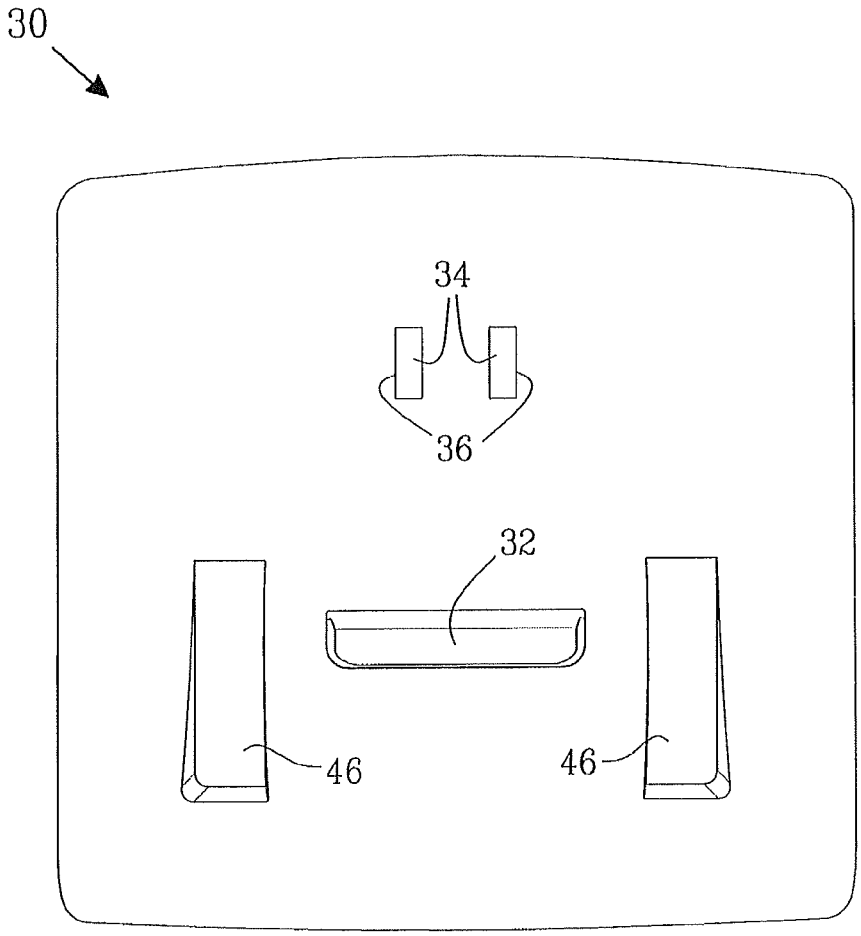
FIG. 3 illustrates a first side portion of a dispenser according to example embodiments.

FIG. 3 illustrates a first side portion 30 of a dispenser according to example embodiments. The first side portion 30 forms a rear side of the container 4 and is provided with a hook 32 forming part of the guiding interconnection and two through holes 34 forming part of the locking interconnection. The hook 32 protrudes outwards from the container 4 and downwards. Outer edge portions 36 of the holes 34, seen from a vertical centre line of the first side portion 30, are arranged to engage with end portions of the above mentioned resilient protrusions 26. Ridges 46 extend rearwards from the first side portion 30 and the container 4.

Figure 4:
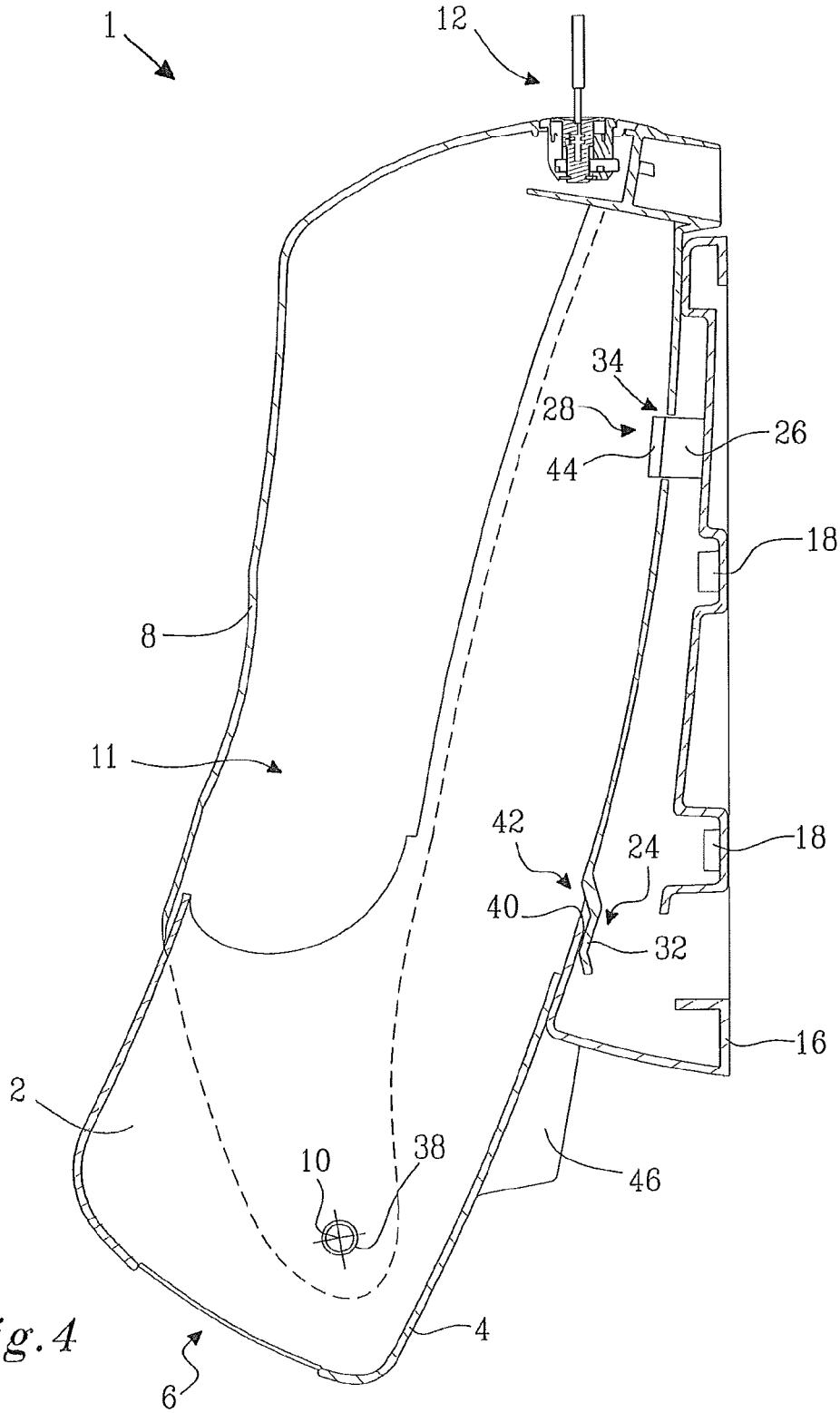
FIG. 4 illustrates a section through a dispenser assembly according to example embodiments with the dispenser securely held to the mounting bracket.

FIG. 4 illustrates a section through a dispenser assembly 1 according to example embodiments with the dispenser 2 securely held to the mounting bracket 16. The container 4 is provided with the dispensing aperture 6 at its lower end and the access opening 11 covered by the lid 8, which may be locked by means of the locking mechanism 12. The lid 8 is attached to the container by means of one journal bearing 38 at each side of the container 4 and may pivot about the axis 10, extending perpendicularly to the section plane shown in FIG. 4.

The hook 32 of the container 4 is engaged with an edge portion 40 of the slot 24 thus, forming a guiding interconnection 42 between the dispenser 2 and the mounting bracket 16. The resilient protrusion 26 is provided with an end portion 44, which is engaged with the edge portion 36 of the through hole 34, see also FIG. 3. A steering protrusion in the form of a ridge 46 at the rear side of the container 4 abuts a side of the mounting bracket 16.

The dispenser 2 is mounted on, and brought to be securely held to, the mounting bracket 16 in the following manner:

- The ridge 46 of the container 4 is brought into abutment with a side of the mounting bracket 16 approximately at the middle of the total mounting bracket height.
- With its upper end held outwardly from the mounting bracket 16 the dispenser 2 is moved downwards such that the hook 32 engages with the edge portion 40 of the slot 24 in the mounting bracket 16.
- In this position the upper end of the dispenser 2 is moved towards the mounting bracket 16 such that the resilient protrusions 26 enter the slots 34 in the first side portion 30 at the rear side of the container 4.
- As the upper end of the dispenser 2 is moved against the mounting bracket 16 the end portions 44 of the resilient protrusions 26 engage with the edge portions 36 of the holes 34, i.e. the locking interconnection 28 in the form of a snap connection engages.

The dispenser 2 is removed from the mounting bracket 16 in the following manner:

- The lid 8 is opened and any hygienic articles covering the locking interconnection 28 are removed.
- The end portions 44 of the resilient protrusions 26 of the snap connection are moved towards each other such that the end portions 44 of the resilient protrusions 26 disengage the edge portions 36 of the holes 34 and the upper end of the dispenser 2 is moved away from the mounting bracket 16.
- When the resilient protrusions 26 are no longer inside the container 4, the dispenser is moved upwards until the hook 32 is no longer engaged with the edge portion 40 of the slot 24.

Even though the invention has been described with reference to example embodiments, many different alterations, modifications and the like will become apparent for those skilled in the art. The slot 24 may for instance be arranged vertically in a front surface of the mounting bracket 16. The slot 24 may be arranged on the container 4 and the hook 32 on the mounting bracket 16. The hook 24 may extend downwards in parallel with the rear side of the dispenser as illustrated. Alternatively, the downward portion of the hook may extend downwards at an angle with the rear side of 1-45 degrees. The snap connection may comprise only one resilient protrusion 26 arranged in a horizontal plane with an edge portion 44 to engage with a lower edge portion of a hole in the first side portion 30 at the rear side of the container 4. There may be provided a steering protrusion with two spaced apart ridges 46 on the rear side of the dispenser such that both ridges 46 may slide along outer sides of the mounting bracket 16 when the dispenser 2 is mounted on the mounting bracket 16.

Even if example embodiments for simplicity have been shown with the dispenser adapted for a stack of tissue towels, the invention also covers other types of dispensers for hygienic articles, such as dispensers for rolled tissue or non-woven webs, where the rolls may be horizontal or vertical.

The invention is even useful for soap dispensers, where the soap portions are to be seen as hygienic articles. Therefore, it is to be understood that the foregoing is illustrative of various example embodiments and is not to be limited to the specific embodiments disclosed and that modifications to the disclosed embodiments, combinations of features of disclosed embodiments as well as other embodiments are intended to be included within the scope of the appended claims.

The invention claimed is:

1. A dispenser assembly comprising a dispenser for hygienic articles and a mounting bracket for releasably attaching said dispenser to a wall, wherein said dispenser comprises:

a container provided with a dispensing aperture for said hygienic articles and an access opening, and comprising a first side portion adapted to be positioned adjacent said mounting bracket, a lid pivotally attached to said container and adapted to cover said access opening; and two spaced apart ridges formed on the dispenser and arranged such that both ridges slide along outer sides of the mounting bracket when the dispenser is mounted on the mounting bracket;

and wherein said dispenser assembly comprises a connecting arrangement for connecting said dispenser to said mounting bracket, said connecting arrangement comprising a locking interconnection for securely holding said first side portion of said container against a front side of said mounting bracket, said mounting bracket having a rear side for mounting to the wall;

wherein said connecting arrangement comprises a guiding interconnection for initially positioning said dispenser in relation to said mounting bracket during mounting of said dispenser to said mounting bracket, wherein during said mounting of said dispenser to said mounting bracket said guiding interconnection provides engagement between said dispenser and said mounting bracket such that said dispenser is prevented from being separated from said mounting bracket in a direction at least perpendicularly outwards from said wall, wherein said guiding interconnection comprises a slot having an edge and an opening arranged perpendicular to the rear side of the mounting bracket and a hook extending from the first side portion of the container and arranged between the two spaced apart ridges, the hook having an end portion adapted to be inserted downwardly into said slot and to engage with the edge portion of said slot wherein a first portion of the hook protrudes downward and outwardly at a first angle relative to the first side portion, a second portion of the hook extends downwardly from the first portion parallel to the first side portion and a third portion extends downwardly and outwardly from the second portion at a second angle relative to the first side portion.

2. The dispenser assembly according to claim 1, wherein during said mounting of said dispenser said guiding interconnection must be engaged prior to said locking interconnection securing said dispenser against said mounting bracket.

3. The dispenser assembly according to claim 1, wherein said locking interconnection comprises a snap connection.

4. The dispenser assembly according to claim 3, wherein said snap connection is adapted to provide one-handed release of said locking interconnection.

5. The dispenser assembly according to claim 3, wherein said snap connection comprises a resilient protrusion arranged on said mounting bracket and is provided with an end portion adapted to engage with an edge portion of a hole provided in said first side portion of said container.

6. The dispenser assembly according to claim 1, wherein said guiding interconnection comprises a single slot and a single hook.

7. The dispenser assembly according to claim 1, wherein said hook of said guiding interconnection is provided on said mounting bracket on a side thereof facing said first side portion of said container and said slot of said guiding connection is provided in said first side portion of said container.

8. The dispenser assembly according to claim 1, wherein said locking interconnection is accessible through said access opening when said lid is open.

9. The dispenser assembly according to claim 8, wherein said dispenser is provided with a locking mechanism for maintaining said lid in a closed position on said container to prevent access through said access opening to said locking interconnection.

10. The dispenser assembly according to claim 1, wherein a projection of said mounting bracket on said wall is smaller than a projection of said dispenser on said wall.

11. The dispenser assembly according to claim 10, wherein externally of said dispenser said first side portion of said container is provided with a steering protrusion adapted to bear against said mounting bracket for lateral positioning of said dispenser in relation to said mounting bracket at least during engaging of said guiding connection.

12. The dispenser assembly according to claim 1, wherein the dispenser assembly comprises a second dispenser comprising a container provided with a first side portion adapted to be positioned adjacent and attached to said mounting bracket.

* * * * *